United States Patent [19]

Beauvent et al.

[11] 3,961,495

[45] June 8, 1976

[54] FROST DETECTING DEVICE FOR A REFRIGERATION APPARATUS

[75] Inventors: Guy Beauvent, Loretteville; Jacques Roy, Ste-Foy, both of Canada

[73] Assignee: Centre de Recherche Industrielle du Quebec, Canada

[22] Filed: Mar. 26, 1975

[21] Appl. No.: 562,053

[52] U.S. Cl. ..... 62/140; 250/341; 340/234

[51] Int. Cl.[2] ..... F25D 21/02

[58] Field of Search ..... 62/140, 139; 250/215, 250/338, 341 X; 340/234

[56] References Cited

UNITED STATES PATENTS

| | | | |
|---|---|---|---|
| 2,849,617 | 8/1958 | Karasek | 250/341 |
| 2,866,900 | 12/1958 | Busignies et al. | 250/341 X |
| 3,120,108 | 2/1964 | Pansing | 62/140 X |
| 3,188,828 | 6/1965 | Wayne | 62/140 |

*Primary Examiner*—William E. Wayner
*Attorney, Agent, or Firm*—Cushman, Darby & Cushman

[57] ABSTRACT

The frost detecting device disclosed herein is adapted to be used in a refrigeration apparatus of the type having refrigerant-carrying coils equipped with fins. The device includes a support to be fixedly mounted to the fins, infrared radiation emitting means mounted to the support, radiation sensitive means also mounted to the support in spaced coaxial relationship with the emitting means, and control circuit means electrically connected to the emitting means and to the sensitive means for detecting an unacceptable amount of frost on the fins to then actuate a defrosting system associated with the refrigeration apparatus.

8 Claims, 7 Drawing Figures

FROST DETECTING DEVICE FOR A REFRIGERATION APPARATUS

FIELD OF THE INVENTION

The present invention relates to a frost detecting device for use in a refrigeration apparatus of the type having refrigerant-containing coils equipped with fins.

BACKGROUND OF THE INVENTION

The problem of frost or ice formation on fins of such refrigerating systems is well known. There exists frost detecting devices which actuate a defrosting unit associated with the refrigeration apparatus by measuring a pressure differential or by measuring temperature; but none exists, however, which takes into consideration the thickness of frost or ice on the fins. The consideration of this thickness is important since it is at the beginning of frost formation that the refrigeration apparatus is most efficient. Hence, it would be extremely ill-timed to actuate the defrosting system when maximum efficiency is being performed.

STATEMENT OF THE INVENTION

It is the purpose of the present invention to provide a detecting device for use in a refrigeration apparatus of the type described which has the particular characteristic of allowing the formation of a certain acceptable amount of frost or ice on the refrigeration apparatus before actuating the defrosting unit; hence, the refrigeration apparatus is permitted to operate during its period of maximum efficiency.

The detection of frost or ice in accordance with the present invention is carried out by means of semi-conductors which are sensitive to the invisible wavelengths of the electromagnetic spectrum. The invention is achieved by mounting on a common radiation axis and infrared emitting means and a sensitive means responsive to the wavelengths of this radiation.

The present invention, therefore, relates to a frost detecting device for use in a refrigeration apparatus of the type having refrigerant-carrying coils equipped with fins, which comprises: a support adapted to be fixedly mounted to the fins; infrared radiation emitting means mounted to the support; radiation sensitive means mounted to the support in spaced relationship with the emitting means, the sensitive means and the emitting means having a common radiation axis; and control circuit means electrically connected to the emitting means and to the sensitive means for detecting an unacceptable amount of frost on the fins whereby a defrosting system associated with the refrigeration apparatus may be actuated.

The reason for using infrared is to eliminate all interference from light or other sources. Infrared rays are more completely absorbed than visible rays in frost, ice or water, which therefore renders their utilization extremely secure during the operation of the detecting device; it eliminates all secondary effects of lens, diffusion, diffraction, etc. which could affect the operation of the radiation means if it were to be used in the visible portion of the spectrum.

In one particular form of the invention, the infrared emission is pulsated at a predetermined frequency so that all signals other than the one emitted by the radiation emitting means are eliminated. This pulsation further ensures that no outside radiation will impede the satisfactory operation of the detecting device.

Other objects and further scope of applicability of the present invention will become apparent from the detailed description given hereinafter; it should be understood, however, that the detailed description, while indicating a preferred embodiment of the invention, is given by way of illustration only, since various changes and modifications within the spirit and scope of the invention will become apparent to those skilled in the art from this detailed description.

DESCRIPTION OF A PREFERRED EMBODIMENT

Figure 1:
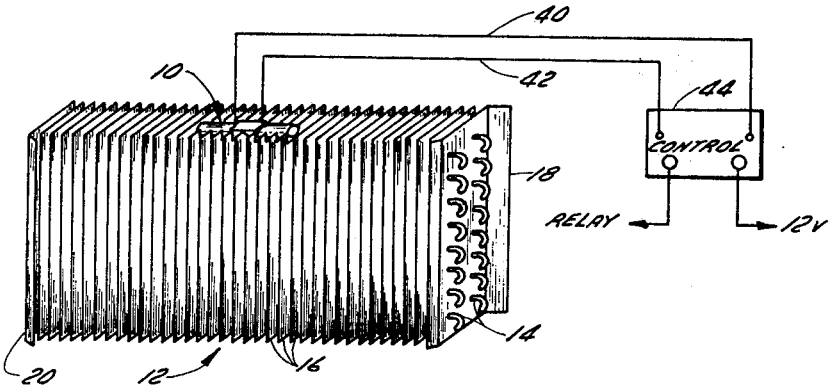
FIG. 1 is a schematic perspective view of a refrigeration apparatus on which has been mounted a frost detecting device made in accordance with the present invention.

With reference to FIG. 1 of the drawings, there is shown a frost detecting device 10 mounted on a conventional refrigeration apparatus 12 for sensing frost conditions thereon.

Although the invention is directed particularly to the frost detecting device 10, the overall cooling operation on the refrigeration apparatus 12 will be described to show that it includes a series of refrigerant containing coils 14 on which are mechanically attached a series of fins 16. The refrigeration apparatus 12 is placed within an area to be refrigerated to absorb heat from air passing through the fins and around the coils. End plates 18 and 20 are provided to securely mount the refrigeration apparatus within the said area.

The refrigerant removes the heat of the surrounding area. During the cooling operation, frost accumulates on the fins and on the coils. The overall coefficient of heat transfer increases with the first several pounds of frost that collects on the coils and fins; then, this value decreases as the frost thickens. The reduction in air flow that occurs in an installation due to frost restricting the air passages lowers the efficiency of the refrigeration system. Hence, the principal object of the frost detecting device 10 is to detect that a predetermined acceptable thickness of frost on the refrigeration apparatus has been exceeded.

Figure 2:
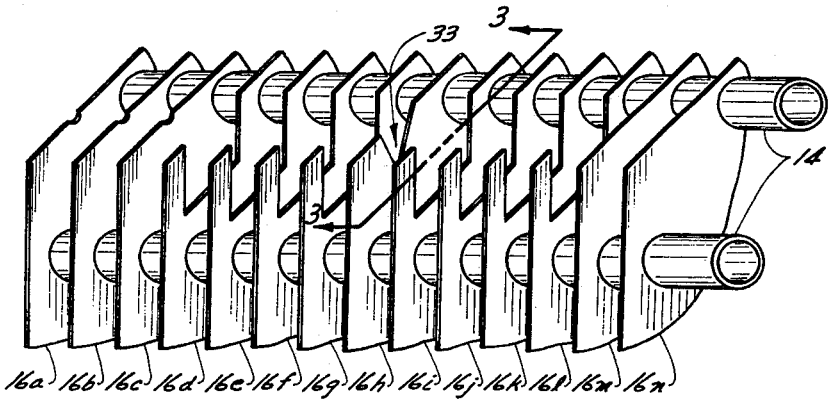
FIG. 2 is an enlarged perspective view of the portion of the refrigeration apparatus on which the frost detecting device is to be removed.

Referring to FIG. 2, it is illustratively represented that, in order to install the frost detecting device 10, fins 16*d*–16*g* and 16*i*–16*l* are cut. These cutout portions are generally rectangular and are preferably located on the side of the refrigeration apparatus which receives the air to be cooled.

Figure 4:
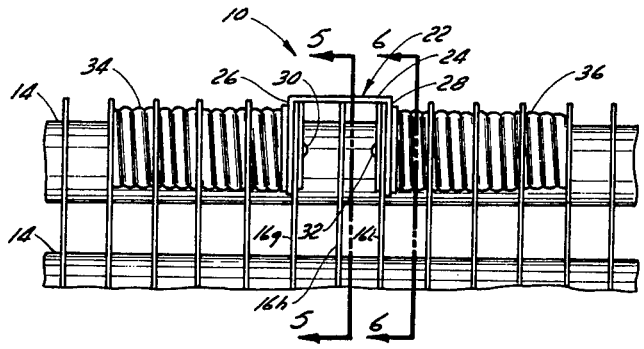
FIG. 4 is a partial elevation view of the refrigeration apparatus with the frost detecting device mounted thereon.

The frost detecting device 10 includes an inverted U-shaped support 22 (see FIG. 4) having a web portion 24 extending over fin 16*h* and two rectangular-shaped side portions 26 and 28 extending parallel and adjacent to the cutout portion of fins 16*g* and 16*i*. Each side portion 26, 28 is provided with coaxially aligned circular openings (not shown) in which are fixedly mounted infrared radiation means 30 and radiation sensitive means 32.

Figure 3:
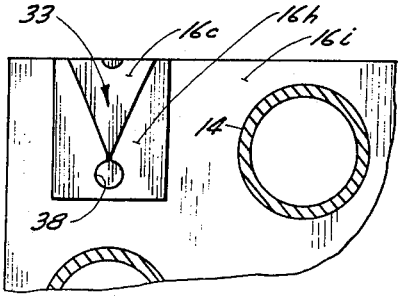
FIG. 3 is an enlarged elevational view as seen from line 3—3 of FIG. 2.
Figure 5:
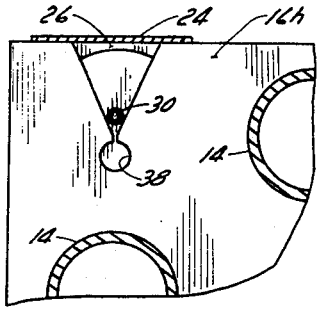
FIG. 5 is an elevational view as seen from line 5—5 of FIG. 4.
Figure 6:
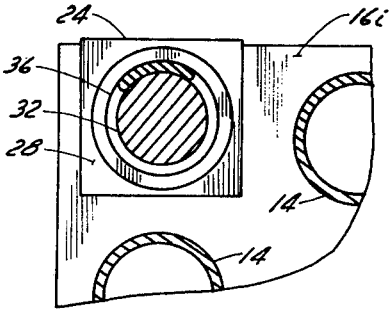
FIG. 6 is an elevational view as seen from line 6—6 of FIG. 4.

The center fin 16*h* includes also a cutout portion 33 which is so situated as to extend in the optical axis of means 30 and 32. Various cutout portions may be used having different shapes, such as the V-shape slot 33 shown, an I or a diamond having an opened upper edge. It is preferable to have a slot rather than a circular hole thereby avoiding that water, obtained as a result of defrosting, remains due to surface tension in the hole, which would impair the transmission of infrared radiation. The slot assists in the downward flow of the water. However, a swell portion 38 (see FIGS. 3 and 5) may be provided at the lower part of the slot and below the optical axis to further ensure the evacuation, in the said portion 38 and out of the radiation axis, of condensation or water.

In the preferred form described, in order to ensure that the frost detecting device is securely mounted to the refrigeration apparatus while at the same time ensuring easy and quick removal therefrom, a pair of springs 34 and 36 are respectively mounted in fixed manner to side portions 26 and 28 of the support. To mount, the two springs are stretched and then positioned over the upper edges of the fins; they are then released and their return action provides a tight connection with the refrigeration apparatus. The characteristics of these coil springs will obviously depend on the rigidity and spacing of the fins.

It has been found that a detecting device constructed in accordance with this preferred embodiment is well suited for refrigeration apparatus used in travelling containers, such as trucks and trains, where the system is subject to considerable vibrations and shocks. It will therefore be appreciated that the present detecting device may be easily and quickly removed from the refrigeration apparatus should it need be replaced or repaired while ensuring, at the same time, a firm attachment to the refrigerating apparatus.

Referring to FIG. 1, the frost detecting device 10 is electrically connected by means of connections 40 and 42 to a control unit 44 which operates a defrosting system associated with the refrigeration apparatus. Defrosting systems are well known and will not be described.

Figure 7:
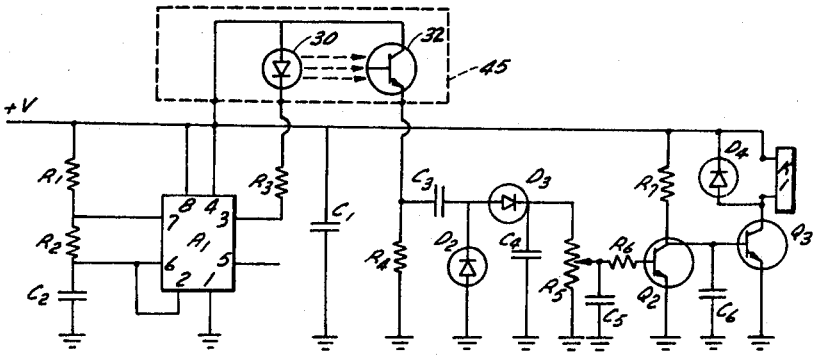
FIG. 7 is an electrical schematic representation of a control system used with the present invention.

FIG. 7 shows one example of an electronic circuit which enables a control of frost accumulation on the refrigeration apparatus. This circuit operates from a battery voltage V, for example 12V, which is filtered by means of a condenser C1. An integrated circuit A1 is connected so as to produce pulses at a given frequency, for example 25 $KH_z$, which frequency is determined by resistances R1, R2 and condenser C2. The output of A1 is connected to the infrared emitting diode 30, the current therein being limited by resistance R3. Diode 30 and the photo-transistor 32 are shown boxed with dotted lines 45 to indicate that they are mounted to the refrigeration apparatus 12. Photo-transistor 32 produces a signal of predetermined voltage at the given frequency in response to rays emitted from diode 30 without frost on the fins; this signal is produced at the junction of condenser C3 and resistance R4 and is then rectified and filtered by C3, diodes D2 and D3, and condenser C4. Resistance R5 determines the limit set to begin the defrosting cycle. Under normal conditions, Q2 is conducting while Q3 is not. Q3 is in series with a relay K1 which controls the defrosting operation. Diode D4, in parallel with relay K1, serves to short-circuit the voltage induced by the coil when Q3 is not conducting.

An optical filter is used for the calibration of the system. When this filter is placed between means 30 and 32, a reference voltage appears at junction R4 and C3 and resistance R5 is adjusted so that the relay may be energized.

A luminous signal of 25 KHz, for example, is used so as to avoid the possibility that a constant light source prevents the system to operate.

When frost accumulates on the refrigeration apparatus, the signal at junction R4-C3 gradually decreases. At the said reference voltage, the set limit is reached, relay K1 is energized and defrosting begins. The defrosting cycle duration is dependent on the time taken by the refrigeration apparatus to reach a predetermined temperature.

Frost is transformed into water and the voltage at C3-R4 varies until the said reference voltage is reached; then, the refrigeration system is again set in operation.

What is claimed is:

1. A frost detecting device for use in a refrigeration apparatus of the type having refrigerant-carrying coils equipped with fins comprising:

a support adapted to be fixedly mounted to said fins;

infrared radiation emitting means mounted to said support;

radiation sensitive means mounted to said support in spaced relationship with said emitting means; said sensitive means and said emitting means having a common radiation axis;

control circuit means electrically connected to said emitting means and to said sensitive means for detecting an unacceptable amount of frost on said fins to then actuate a defrosting system associated with the refrigeration apparatus, said control circuit means including means for pulsating at a predetermined frequency said infrared radiation from said emitting means so that undesired signals are thereby eliminated.

2. A frost detecting device as defined in claim 1, wherein said support is in the shape of a U with a web portion and a pair of opposite leg portions; a pair of axially aligned openings being provided in said leg portions and receiving said sensitive means and said emitting means respectively therein.

3. A frost detecting device as defined in claim 2, further comprising coil spring means mounted to each leg portion and extending axially with said sensitive means and said emitting means, respectively; said coil spring means being so received on said fins as to allow easy removal of said detecting device from said refrigeration apparatus.

4. In combination, a. a refrigeration cooling element apparatus including:

i. at least one refrigerant-containing coil; and ii. a plurality of spaced fins mechanically attached to said coil, at least one of said fins having a slot therethrough;

b. a frost detecting device including:

i. a support fixedly mounted to said fins;

ii. infrared radiation emitting means carried by said support and received in said refrigeration apparatus adjacent one side of said one fin;

iii. radiation sensitive means carried by said support and received in said refrigeration apparatus adjacent the opposite side of said one fin; said emitting means, slot and sensitive means being axially aligned so that infrared radiation emitted from said emitting means may pass through said slot and be received on said sensitive means;

iv. control circuit means electrically connected to said emitting means and to said sensitive means for detecting an unacceptable amount of frost in said slot to then actuate a defrosting system associated with the refrigeration apparatus, said control circuit means including means for pulsating at a predetermined frequency said infrared radiation from said emitting means so that undesirable signals are thereby eliminated.

5. The combination according to claim 4, wherein fins located on either side of said one fin have in the upper ends thereof a cutout portion to receive therein said emitting means and said sensitive means, respectively.

6. The combination according to claim 5, wherein said support is in the form of an inverted U with a web portion and two leg portions each provided with an opening therethrough; said web portion extending over said one fin and said leg portions extend downwardly on either side thereof; said emitting means and said sensitive means being received in said openings respectively.

7. The combination according to claim 6, further comprising coil spring means mounted to each leg portion and extending co-axially with said emitting means and said sensitive means; said coil spring means being so received on the upper end of adjacent fins so as to allow easy removal of said detecting device from said refrigeration apparatus.

8. The combination according to claim 4 wherein said slot has a V-shaped portion with a swell portion at the lower part thereof; said swell portion being located outside the radiation axis to ensure evacuation of defrosted water from said V-shaped portion.

* * * * *